US008012550B2

(12) United States Patent
Ylitalo et al.

(10) Patent No.: US 8,012,550 B2
(45) Date of Patent: Sep. 6, 2011

(54) INK RECEPTIVE ARTICLE

(75) Inventors: Caroline M. Ylitalo, Stillwater, MN (US); Scott A. Boyd, White Bear Lake, MN (US); Joseph C. Carls, Austin, TX (US); Eugene H. Carlson, Apple Valley, MN (US); Christopher K. Haas, St. Paul, MN (US); James M. Jonza, Woodbury, MN (US); Mark J. Pellerite, Woodbury, MN (US); Robert F. Watkins, White Bear Lake, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 1035 days.

(21) Appl. No.: 11/538,606

(22) Filed: Oct. 4, 2006

(65) Prior Publication Data

US 2008/0085384 A1 Apr. 10, 2008

(51) Int. Cl.
*B41M 5/40* (2006.01)

(52) U.S. Cl. ..... 428/32.13; 428/32.26; 428/32.34; 428/32.238; 428/304.4; 428/307.7; 428/308.4; 428/327; 428/331; 428/916

(58) Field of Classification Search ..... 428/32.13, 428/32.26, 32.34, 32.38, 304.4, 307.7, 308.4, 428/327, 331, 916
See application file for complete search history.

(56) References Cited

U.S. PATENT DOCUMENTS

| | | | | |
|---|---|---|---|---|
| 4,714,716 | A | | 12/1987 | Park |
| 4,916,198 | A | | 4/1990 | Scheve et al. |
| 4,940,736 | A | | 7/1990 | Alteepping et al. |
| 5,023,129 | A | * | 6/1991 | Morganti et al. ..... 428/195.1 |
| 5,429,856 | A | | 7/1995 | Krueger et al. |
| 5,508,105 | A | | 4/1996 | Orensteen et al. |
| 5,518,809 | A | | 5/1996 | Henry et al. |
| 5,605,936 | A | | 2/1997 | DeNicola, Jr. et al. |
| 5,660,919 | A | | 8/1997 | Vallee et al. |
| 5,834,098 | A | | 11/1998 | Kitamura et al. |
| 5,882,774 | A | | 3/1999 | Jonza et al. |
| 6,360,035 | B1 | | 3/2002 | Hurst, Jr. et al. |
| 6,436,515 | B1 | | 8/2002 | Ohbayashi et al. |
| 6,464,351 | B1 | * | 10/2002 | Landry-Coltrain et al. .. 347/105 |
| 6,531,230 | B1 | | 3/2003 | Weber et al. |
| 6,589,636 | B2 | | 7/2003 | Emslander et al. |
| 6,696,390 | B1 | | 2/2004 | Hatada et al. |
| 6,720,042 | B2 | | 4/2004 | Ylitalo et al. |

(Continued)

FOREIGN PATENT DOCUMENTS

| | | |
|---|---|---|
| EP | 615788 | 9/1994 |

(Continued)

OTHER PUBLICATIONS

J.I. Raukola, "A New Technology to Manufacture Polypropylene Foam Sheet and Biaxially Oriented Foam Film," VTT Publications 361, Technical Research Centre of Finland, 101 pages, ESPOO, 1998.

*Primary Examiner* — Betelhem Shewareged

(57) ABSTRACT

An ink receptive article including a substrate having on at least a portion of a major surface thereof an antistatic layer, and wherein the antistatic layer has on at least a portion of a major surface thereof an ink receptive layer, wherein the ink receptive layer includes a crosslinked polymer selected from the group consisting of polyurethanes, polyethers, polyesters, polyacrlylics, polyureas, copolymers thereof, and blends thereof.

53 Claims, 1 Drawing Sheet

U.S. PATENT DOCUMENTS

| | | | | |
|---|---|---|---|---|
| 6,723,433 | B2 | 4/2004 | Bacon, Jr. | |
| 6,897,183 | B2 | 5/2005 | Arrington et al. | |
| 2002/0022118 | A1 | 2/2002 | Sarkar et al. | |
| 2002/0094418 | A1 | 7/2002 | Landry-Coltrain et al. | |
| 2002/0142141 | A1 | 10/2002 | Miller | |
| 2002/0164460 | A1 | 11/2002 | Bacon, Jr. | |
| 2003/0072931 | A1 | 4/2003 | Hebrink et al. | |
| 2003/0077429 | A1 | 4/2003 | Shulz | |
| 2003/0207094 | A1 | 11/2003 | Carls et al. | |
| 2003/0228428 | A1* | 12/2003 | Kim et al. | 428/32.1 |
| 2003/0232210 | A1 | 12/2003 | Haas et al. | |
| 2004/0018344 | A1 | 1/2004 | Watkins et al. | |
| 2004/0048073 | A1 | 3/2004 | Bacon, Jr. | |
| 2005/0129883 | A1 | 6/2005 | Snow | |
| 2008/0247788 | A1 | 10/2008 | Ayaki et al. | |

FOREIGN PATENT DOCUMENTS

| | | |
|---|---|---|
| WO | 91/12372 | 8/1991 |
| WO | 99/03929 | 1/1999 |
| WO | 99/36466 | 7/1999 |
| WO | 99/61520 | 12/1999 |
| WO | 00/00520 | 1/2000 |
| WO | 00/68714 | 11/2000 |
| WO | 02/00412 | 1/2002 |
| WO | 03/039883 | 5/2003 |

* cited by examiner

INK RECEPTIVE ARTICLE

The present disclosure is directed to an antistatic article having an ink-receptive layer applied thereon, and a method of making the article.

BACKGROUND

Conventional security documents such as currency, stock and bond certificates, birth and death certificates, land titles and the like are typically made of paper. However, paper, even the more durable security paper, is not particularly durable. Since polymeric materials may be more resistant to damage caused by handling, environmental exposure and water, they may be used to replace paper for security document applications.

Polymeric documents offer several benefits over their paper counterparts. In particular, polymeric security documents can offer greatly increased durability and resistance to counterfeiting through the incorporation of security features. Holograms and other diffractive or interference optical layers are often applied to the surface of banknotes, as are optically variable and intaglio inks. The polymeric security documents may also have certain physical properties that are similar to the more commonly used paper banknotes, such as tactile feel, strength, tear resistance, handling, folding, and crumple resistance.

However, the capture of the image-forming ink on polymeric substrates presents a technical challenge because plastic film is substantially impervious to liquids. For example, US 2003/0232210 A1, incorporated herein by reference, describes security document substrates made from oriented foam polyolefin films. An ink receptive surface is provided on the oriented polyolefin foam to capture and retain an image forming ink. The ink receptive surface is prepared by corona or flame treating the surface of the oriented foam polymeric film, by applying to the oriented foam polymeric film a suitable ink receptive primer coating, or by laminating or coextruding onto the oriented foam polymeric film an ink receptive polymer film.

Typically, ink receptive coatings are made of highly filled binder compositions where the filler content usually is greater by weight than the polymer binder. Such high filler concentration is needed to create micro porous structures in the coating, where the ink is absorbed into the pores by capillary action. For synthetic films made of polyolefin materials, coatings with high filler content have very poor adhesion to the substrate. Therefore, there is a need to develop ink receptive coatings for substrates that have low filler content with good ink absorption and good adhesion to the substrate.

SUMMARY

In one aspect, the present disclosure is directed to an ink receptive article including a substrate having on at least a portion of a major surface thereof an antistatic layer, and wherein the antistatic layer has on at least a portion of a major surface thereof an ink receptive layer, wherein the ink receptive layer includes a crosslinked polymer selected from the group consisting of polyurethanes, polyethers, polyesters, polyacrylics, polyureas, copolymers thereof, and blends thereof.

In another aspect, this disclosure is directed to a method for making an ink receptive article, including applying on at least a portion of a major surface of a substrate a composition including an antistatic agent to form an antistatic layer, applying on at least a portion of a major surface of the antistatic layer a dispersion including water, a crosslinker and a polymer selected from the group consisting of polyurethanes, polyureas, acrylics, and urethane/copolymers; and drying the dispersion to form an ink receptive coating layer.

In yet another aspect, this disclosure is directed to an ink receptive article including a substrate including an oriented foam layer, wherein the substrate has an antistatic layer on at least a portion of a major surface thereof, the antistatic layer including a static dissipating compound, and an ink receptive layer on a least a portion of the antistatic layer, wherein the ink receptive layer includes at least one crosslinked polymer.

In still another aspect, the present disclosure is directed to an ink receptive article including a substrate having thereon an antistatic layer and an ink receptive layer, wherein the ink receptive layer includes a polymer selected from the group consisting of polyurethanes, polyethers, polyesters, polyacrylics, polyureas, copolymers thereof, and blends thereof, and a crosslinker, wherein the crosslinker is present at 0.1 wt % to 10 wt % of the amount of polymer in the ink receptive layer.

In another aspect, the present disclosure is directed to a security document including a substrate having on at least a portion of a major surface thereof an antistatic layer, and wherein the antistatic layer has on at least a portion of a major surface thereof an ink receptive layer, wherein the ink receptive layer includes a crosslinked polymer selected from the group consisting of polyurethanes, polyethers, polyesters, polyacrylics, polyureas, copolymers thereof, and blends thereof.

The ink receptive article is particularly useful in the preparation of printed security documents such as currency, stock and bond certificates, birth and death certificates, passport pages, checks, titles and abstracts and the like. These articles exhibit improved crumple and crease recovery compared to previously known multilayer optical films, synthetic papers, or currency papers. The proper modulus and tear strength, superior folding endurance, and crumple and crease recovery properties fits the market need for increased durability. The articles described herein may provide security characteristics, such as color shifting inks or films, embossments, translucent or transparent regions, holographic indicia and the like.

The ink receptive layer described in this disclosure is suitable for use with a wide variety of inks. The ink receptive article described in this disclosure also exhibits improved static dissipation properties, which make sheets of the polymeric materials to which the coating is applied easier to handle and feed into counting and printing machines. In addition, the ink receptive article described in this disclosure also provides to the polymeric security document substrate improved anti-blocking properties, which makes the sheets to which the ink receptive coating is applied less likely to adhere to one another prior to printing, and provides an air gap that allows drying/curing of inks after printing. The ink receptive article described in this disclosure also provides enhanced resistance to attack by chemicals frequently encountered in environments where currency and security documents are used.

DETAILED DESCRIPTION

Figure 1:
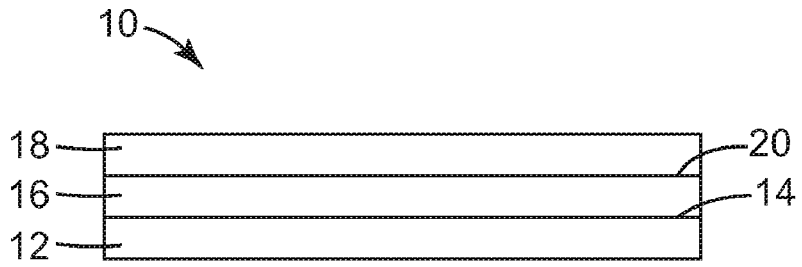
FIG. 1 is a cross sectional view of a multilayer ink receptive article.

In one aspect, this disclosure describes an ink receptive article including a substrate having an antistatic layer and an ink receptive coating layer thereon.

The ink receptive coating layer is typically formulated to provide a level of ink receptivity tuned for a particular printing technique and related ink used in that printing technique. The ink receptive coating layer must also survive a variety of chemical and mechanical failure tests used to evaluate printed security documents. The major component in the ink receptive coating layer is a polymer selected from, for example, polyurethanes, polyethers, polyesters, polyacrylics, polyureas, copolymers thereof, and blends thereof. Preferred polymers include polyurethanes and acrylic polymers, or a urethane and acrylic copolymer.

The ink receptive layer is preferably coated from a water-based coating solution that can be coated on and adhere to a particular substrate. The coating solution is then cured and/or dried to remove water and any other solvents present in the coating solution to form the finished ink receptive coating. Preferably, the ink-receptive coating is water and chemical resistant when cured and/or dried under appropriate conditions.

The coating solution for the ink receptive layer is preferably an aqueous dispersion including water and a polymeric binder. Suitable aqueous dispersions include urethanes such as those available under the trade designation NEOREZ from DSM Neoresins, Wilmington, Mass., particularly NEOREZ R-960 and NEOREZ R-9699; acrylics such as those available under the trade designation NEOCRYL from DSM Neoresins, particularly NEOCRYL XK-90, NEOCRLYL XK-96 and NEOCRYL XK-95; and, acrylic urethane copolymers such as those available under the trade designation NEOPAC from DSM Neoresins. Other water-based urethanes suitable for use in the ink receptive layer include RU-077 and RU-075 available from Stahl USA, Peabody, Mass.

The polymers and copolymers making up the ink receptive layer may optionally be crosslinked to provide greater chemical resistance. Suitable examples of crosslinkers for the ink receptive layer include aziridine crosslinkers available under the trade designation CX-100 from DSM Neoresins. Other suitable crosslinkers for use in the coating solution for the ink receptive layer include carbodiimides such as those available under the trade designation EX62-944, and melamines such as those available under the trade designation XR-9174, both available from Stahl USA. The amount of crosslinking in the ink receptive layer should be carefully controlled to maintain a balance between chemical resistance and a desired level of adhesion of the ink receptive layer to the foam or non-foam layer. Increased crosslink density tends to reduce both ink absorption in the ink receptive layer and adhesion of the ink receptive layer to the foam or non-foam layer. Typically the cross-linker is added in an amount equal to 0.1 wt % to 10 wt %, preferably 0.3 wt % to 3 wt %, of the polymer or copolymer making up the major component of the ink receptive layer.

Self cross-linking polymer dispersions maybe used in the ink receptive layer. Such polymeric dispersions have a self cross-linking function that is activated when the coating layer is dried. Depending on the intended application, the use of this type of dispersion may reduce or eliminate the need for incorporating crosslinking compounds into the coating composition. Examples of self cross-linking polymer dispersions that are suitable for this application include Neorez R-661, a self-cross-linking polyether polymer dispersion available from DSM Neoresins.

The ink receptive article described in this disclosure has antistatic properties. In one embodiment, an antistatic agent may be included in the ink receptive coating layer. In another embodiment, the ink receptive article may include a separate antistatic layer, preferably between the substrate and the ink receptive coating layer. More preferably, the antistatic layer is adjacent the substrate, and in a presently particularly preferred construction the antistatic layer is sandwiched between the substrate and the ink receptive coating layer. Further, in any of these embodiments, the substrate itself may optionally include an antistatic agent. The antistatic layer is preferably applied directly on the substrate and the ink receptive layer is applied on the antistatic layer, although in some embodiments additional intermediate layers may be included between the antistatic layer and the ink receptive layer. Optionally, the antistatic layer is applied over the ink receptive layer to form the topmost layer of the multilayer ink receptive article.

A wide range of antistatic agents are suitable for use in the ink receptive layer or in the antistatic layer, but preferred antistatic agents are colorless or neutral to the other components in the ink receptive coating, not viscosity prohibitive to provide ease of coating, and conductive. Preferred antistatic agents include vanadium pentoxide, metal salts such as lithium or other quaternary ammonium salts in combination with a PEG functionalized material, and aqueous dispersions of conductive polymers PEDT/PSS (poly(3,4-ethylenedioxythiophene) poly(styrenesulfonate)) available under the trade designation BAYTRON from HC Stark, a division of Bayer AG, particularly BAYTRON P. Another type of conductive material useful as an antistatic agent are based on antimony oxide, and examples include those sold under the trade designation Celnax available from Nissan Chemical Industries (Japan), particularly CX-Z610M- F.

Vanadium pentoxide (vanadia) provides excellent static dissipation at very low concentrations due to its geometry in the form of needles with very large aspect ratio. The vanadia may be incorporated into the static dissipating layer by coating as a separate layer to provide static dissipation. Typically a monolayer of vanadia needles, a few angstroms thick, is sufficient to obtain good static dissipation. Flow agents, surfactants, and binders may be added to the vanadium pentoxide solution as long as such additives do not destabilize or destroy the needle structure of the vanadia.

The antistatic agent can be applied as part of the ink receptive coating or as part of a separate antistatic layer. When incorporated as part of the ink receptive coating, the concentration of the antistatic agent may vary widely, and depends on the type of agent used. Typically, the amount of antistatic agent ranges from 1% and up to 50% by weight of the dry ink receptive coating layer. For example, when Baytron P antistatic agent is used, the preferred concentration is between 20% and 50% of the dry coating weight of the ink receptive coating layer. When the antistatic agent is applied as part of a separate antistatic layer, its concentration in the antistatic layer can range from 1% and up to 100% by weight of the dry antistatic coating layer. For example, when vanadia is coated as a separate antistatic layer, its concentration in the antistatic layer is between 20% and 100% of the dry coating weight of the antistatic coating layer.

Antiblocking properties of the articles described herein are important to provide good feeding into printing machines. This property may be measured by standard friction tests. Given the non-absorbing nature of the non-foam plastic and foam substrates, it is preferred to provide a surface texture for the ink receptive layer that would allow an air gap between sheets of the unprinted substrate film material. For example, currency inks generally cure via oxidation, so a pathway for oxygen to reach the ink is important in solidifying the ink. The coating solution for the ink receptive layer may optionally include beads or particles that have a diameter similar to or greater than the coating thickness of the layer. For example, hollow or solid glass microspheres, crosslinked polymer beads, and porous silica beads and combinations thereof may be incorporated into the ink receptive layer or the foam or non-foam substrate films to provide antiblocking properties. It is not necessary for the beads, particles or microspheres to have a spherical shape, and distributions of sizes also reduce the static and dynamic coefficients of friction.

Cross-linked polymer beads are the preferred antiblocking agent for the coating. Such beads are preferred over glass beads because they do not dull the cutting blades when the substrate is cut into sheets, and they can be obtained in monodisperse sizes. Typical concentration ranges from 2% to 20% by weight of the dry coating weight of the ink receptive coating layer, and more preferably between 5% and 15% of the dry coating weight. The diameter of the polymer beads should preferably be greater than the dry coating thickness of the ink receptive coating layer so that the beads act as spacers.

To impart antiblocking properties, small amounts of slip agent may be incorporated into the coating composition. Preferred slip agents include those sold under the trade designation Neorez R-9649 available from DSM Neoresins. When a slip agent is used, it is typically added in amounts between 1% and 5% by weight of the polymer.

The ink receptivity of the ink receptive coating layer may be improved by adding ink absorbers, which are typically inorganic particles such as metal oxides and silicas. Preferred metal oxides include titanium oxides such as rutile, titanium monoxide, titanium sesquioxide; silicon oxides, surfactant coated silica particles, zeolites, and surface treated derivatives thereof such as for example fluorinated silicas as described in PCT published Patent Appl. No. WO 99/03929; aluminum oxides, for example boehmite, pseudo-boehmite, bayerite, mixed oxides such as aluminum oxyhydroxide, alumina particles having a silica core; zirconium oxides such as zirconia and zirconium hydroxide; and mixtures thereof. Silicon oxides (also referred to as silicas) and aluminum oxides (also referred to as aluminas) are especially preferred.

Silicas useful in the ink receptive layer include amorphous precipitated silicas, fumed silicas or a mixture thereof. Such silicas have typical primary particle sizes ranging from about 15 nm to about 10 μm, preferably about 100 nm to about 10 μm. These particle sizes span a wide range in part because two different types of silicas may be used in the ink absorbing layer.

A typical concentration range for the inorganic additive in the ink receptive coating layer ranges between about 5% and about 20% by weight of the dry coating. An example of a suitable fumed silica is available under the trade designation CAB-O-SIL from Cabot Corporation, (Billerica, Mass.). Another suitable silica material that is useful as an ink absorber is a porous amorphous silica bead available under the trade designation GASIL from Ineos Silicas, Ltd. (Warrington, England).

Dye mordants may also optionally be used to fix the printed ink to the ink receptive coating layer. Any conventional dye mordant may be used such as, for example polymeric quaternary ammonium salts, poly(vinyl pyrrolidone), and the like.

In addition to the ink absorbing inorganic materials described above, the ink receptive coating layer may also contain a particulate additive to enhance the smoothness characteristics of the surface of the ink receptive layer, particularly after it has been printed. Suitable particulate additives includes inorganic particles such as silicas, chalk, calcium carbonate, magnesium carbonate, kaolin, calcined clay, pyrophylite, bentonite, zeolite, talc, synthetic aluminum and calcium silicates, diatomatious earth, anhydrous silicic acid powder, aluminum hydroxide, barite, barium sulfate, gypsum, calcium sulfate, and the like; and organic particles such as polymeric beads including beads of polymethylmethacrylate, copoly(methylmethacrylate/divinylbenzene), polystyrene, copoly(vinyltoluene/t-butylstyrene/methacrylic acid), polyethylene, and the like. Such polymeric beads may include minor amounts of divinylbenzene to crosslink the polymers. The ink receptive layer may also contain a colorant, e.g., a dye or pigment. This layer may contain components which strongly absorb ultraviolet radiation thereby reducing damage to underlying images by ambient ultraviolet light, e.g., such as 2-hydroxybenzophenones; oxalanilides; aryl esters and the like; hindered amine light stabilizers, such as bis(2,2,6,6-tetramethyl-4-piperidinyl) sebacate and the like; and combinations thereof.

Organic acids which may be used to adjust the pH and hydrophilicity in the ink receptive layer typically are non-volatile organic acids such as alkoxyacetic acids, glycolic acid, dibasic carboxylic acids and half esters thereof, tribasic carboxylic acids and partial esters thereof, aromatic sulfonic acids, and mixtures thereof. Preferred organic acids include glycolic acid, methoxy acetic acid, citric acid, malonic acid, tartaric acid, malic acid, maleic acid, fumaric acid, itaconic acid, succinic acid, oxalic acid, 5-sulfo-salicycilic acid, p-toluenesulphonic acid, and mixtures thereof. Optical brighteners that may be used to enhance the visual appearance of the imaged layer may be any conventional, compatible optical brightener, e.g., such as optical brighteners marketed by Ciba-Geigy under the trade designation TINOPAL.

A coating solution used to make the ink-receptive layer may optionally include a thickener. In particular the thickener may be selected to provide a combination of high viscosity at low shear rates and low viscosity at high shear rates. Examples of thickeners that may be suitable in some applications include: starch, gum arabic, guar gum, and carboxymethylcellulose. A preferred thickening agent is sold under the trade designation NEOCRYL-A1127 available from DSM Neoresins. Additionally, the coating solution may further comprise an opacifying agent.

The coating solution is preferably water-based, but additional cosolvents maybe used. Examples of cosolvents include glycol ethers (e.g., diethylene glycol), water soluble alcohols (e.g., isopropyl alcohol) and 1-methyl-2-pyrrolidone In some applications it may be advantageous to include a surfactant in the coating solution to aid in wetting the substrate. Examples of surfactants that may be suitable in some applications include anionic surfactants, cationic surfactants, nonionic surfactants, and zwitterionic surfactants. Examples of trade designations for surfactants include ZONYL, FLUORAD, SYRFINOL, and BYK. ZONYL FSN is a trade designation for a fluorinated surfactant available from E. I. Du Pont de Nemours Corporation of Wilmington, Del., USA. FLUORAD FC-754 WELL STIMULATION ADDITIVE is a trade designation for a fluorinated surfactant available from 3M Co. of St. Paul, Minn., USA. BYK 333 is available from BYK Chemie (Germany).

When the antistatic composition is applied as a separate layer onto the ink receptive article, the antistatic layer typically includes some or all of the components used in the ink receptive coatings described above. Inorganic fillers and antiblocking agents may optionally be used in the antistatic layer.

Also, when a separate antistatic layer is applied, the ink receptive layer need not contain an antistatic agent. However, it is within the scope of this invention to include an antistatic agent in the ink receptive layer even when a separate antistatic layer is applied to the ink receptive article.

It was surprisingly found that the antistatic layer of the invention is effective in dissipating static charge from the ink receptive article surface even when such layer is sandwiched between the surface of the article and an ink receptive coating layer that is free of antistatic agents as shown in FIG. 1.

When applying an ink-receptive coating solution on an oriented foam substrate as described below, the ink receptive layer has a weight of between about 0.5 and about 250 g/m$^2$. In a preferred embodiment, the ink receptive coating layer has a weight of between about 1 and about 100 g/m$^2$. In a particularly preferred embodiment, the image receptive layer has a weight of between about 2 and about 50 g/m$^2$. The coating weight can vary depending on fillers, inorganic materials, additives, etc.

Examples of application techniques for the ink receptive coating layer, which may be suitable in some applications, include coating, printing, dipping, spraying, and brushing. Examples of coating processes that may be suitable in some applications include direct and reverse roll coating such as Gravure coating, knife coating, spray coating, flood coating, and extrusion coating. Examples of printing processes that may be suitable in some applications include screen-printing and gravure printing.

Following the coating step, the coating solution is then cured and/or dried to form the ink receptive layer. Drying can take place at room temperature or at elevated temperatures. Oven drying is preferred where oven temperatures ranging between 50° C. and 150° C. are optimum in order to initiate the cross-linking reaction in the coating and drive off the water and solvents if present in a reasonable amount of time.

The antistatic layer, when applied separately, is typically dried before applying the ink receptive layer.

The antistatic layer is typically thinner than the ink receptive layer with typical dry layer coating thickness as low as a few angstroms and up to 10 μm. The dried and/or cured combined antistatic and ink receptive layers typically have a total thickness of 1 μm to 50 μm, preferably 6 μm to 50 μm.

The substrate on which the ink receptive coating layer is coated may vary widely depending on the intended application. Typically, the substrate is a plastic film, and in a preferred embodiment is an oriented foam such as that described in US 2003/0232210, which is incorporated herein by reference. Other films may include films with optical properties, such as, for example, the nanolayer birefringent optical film described in, for example, published U.S. Application No. 2003/0072931A1. In addition, regions of a substrate that are impervious to ink due to vapor coatings (for example, interference and diffractive foils) may also benefit from the ink receptive coatings described herein. In these cases, the ink receptive coating may cover only selected regions, which may allow the optical effect to be seen without any haze where there is no coating applied.

Referring to FIG. 1, an embodiment of an ink receptive article 10 is shown that includes a substrate 12 with a major surface 14 having applied on at least a portion thereof an antistatic layer 16. The ink receptive article 10 also includes an ink receptive coating layer 18 on at least a portion of a major surface 20 of the antistatic layer 16.

Figure 2:
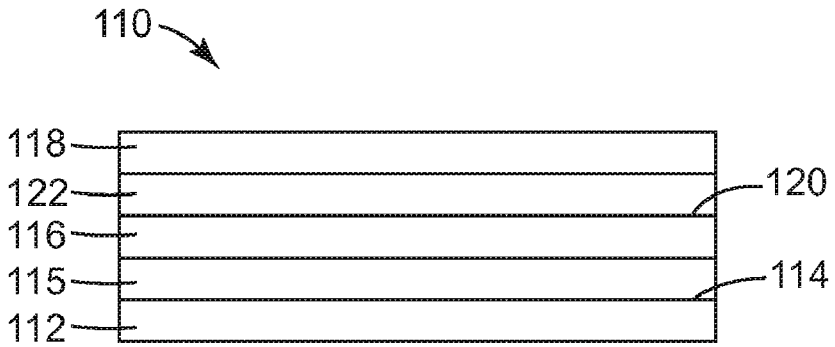
FIG. 2 is a cross sectional view of a multilayer ink receptive article.

In an alternative embodiment shown in FIG. 2, the ink receptive article 110 includes a substrate 112 with a major surface 114. The major surface 114 of the substrate 112 has applied thereon an optional intermediate layer such as, for example, a tie layer 115 or other layer selected to enhance the adhesion of the antistatic layer to the substrate, or to provide enhanced physical properties to the ink receptive article 110. On at least a portion of the tie layer 115 is applied an antistatic layer 116. Optional intermediate layers 122 may also be applied between the antistatic layer 116 and an ink receptive coating layer 118 to enhance the adhesion of the ink receptive coating layer to the substrate, or to provide enhanced physical properties to the ink receptive article 110.

Figure 3:
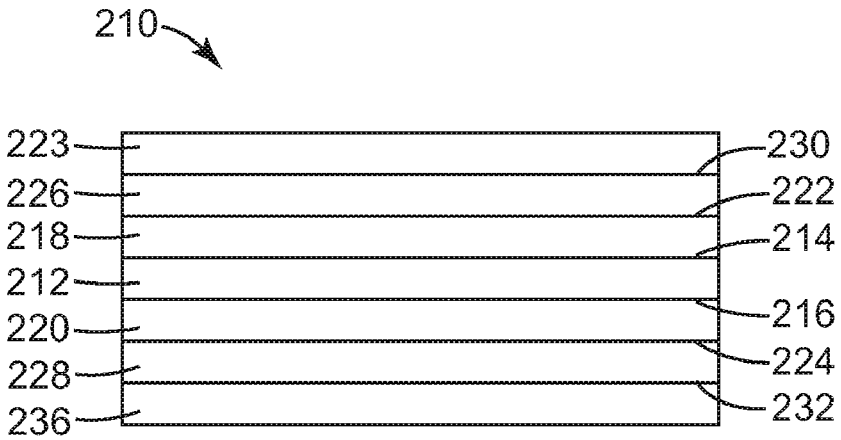
FIG. 3 is a cross sectional view of a multilayer ink receptive article.

In one presently preferred embodiment, the antistatic ink receptive layer is part of a multilayer ink-receptive article including at least one oriented, high melt strength polypropylene foam layer such as that described in US 2003/0232210. The ink receptive article also preferably includes at least one non-foam layer. Referring to FIG. 3, in one embodiment the ink receptive article 210 includes a non-foam layer 212, typically a thermoplastic film. On each major surface 214, 216 of the non-foam layer 212 is applied a foam layer 218, 220. A antistatic layer 226, 228 is applied to at least a portion of each exposed major surface 222, 224 of the foam layers 218, 220. An ink receptive layer 234, 236 is applied to at least a portion of each exposed major surface 230, 232 of the antistatic layers 226, 228. Optional intermediate layers (not shown in FIG. 3) may be sandwiched between either of the antistatic layers 226, 228 and the foam layers 218, 220, or between the antistatic layers 226, 228 and the ink receptive layers 230, 232.

The non-foam film layer 212 can be used in the multilayer article 210 to improve the physical properties of the article, including handling characteristics such as bending stiffness. In some embodiments, non-foam layers are selected to provide the article with a bending stiffness of at least 40 Newtons. As such, as shown in FIG. 3 the multilayer article preferably has the construction foam/film/foam, where one or both of the outermost foam layers are ink-receptive and the inner film layer is used to improve the handling properties such as bending stiffness. The foam/film/foam constructions, with the softer foam layers on the outside, feel more like paper.

The non-foam film layer 212 could also be a security film. This security film may contain transparent colored dyes, or opaque colored pigments, which may be easily differentiated when the security document is held up to view in transmitted light. Additionally, if the film is a multilayer optical film such as, for example, those described in U.S. Pat. No. 5,882,774, U.S. Pat. No. 6,531,230, or U.S. published patent application No. 2003/0072931A1, this will be revealed more fully in the embossed regions, where foam cells are collapsed. The multilayer optical film may be oriented at the same temperature as the polypropylene foams, allowing for economical, one-step manufacturing. Alternatively, the film need not be continuous if it is placed inside the foam layers via lamination. In another embodiment, printing on the internal surface(s) with ordinary or security inks may be done prior to laminating foam layers together.

Polymeric materials used in the non-foam layer of the ink receptive articles include one or more melt-processable organic polymers, which may include thermoplastic, or thermoplastic elastomeric materials. Thermoplastic materials are generally materials that flow when heated sufficiently above their glass transition temperature, or if semi-crystalline, above their melt temperatures, and become solid when cooled. Thermoplastic materials useful in the ink receptive articles described in this disclosure that are generally considered nonelastomeric include, for example, polyolefins such as isotactic polypropylene, low density polyethylene, linear low density polyethylene, very low density polyethylene, medium density polyethylene, high density polyethylene, polybutylene, nonelastomeric polyolefin copolymers or terpolymers such as ethylene/propylene copolymer and blends thereof, ethylene-vinyl acetate copolymers such as those available under the trade designation ELVAX from E. I. DuPont de Nemours, Inc., Wilimington, Del.; ethylene acrylic acid copolymers such as those available under the trade designation PRIMACOR from E. I. DuPont de Nemours; ethylene methacrylic acid copolymers such as those available under the trade designation SURLYN from E. I. DuPont de Nemours, Inc.; ethylene vinyl actetate acrylate copolymers such as those available under the trade designation BYNEL from E. I. DuPont de Nemours, Inc.; polymethylmethacrylate; polystyrene; ethylene vinyl alcohol; polyesters including amorphous polyester; cycloaliphatic amorphous polyolefins such as those available under the trade designation ZEONEX available from Zeon Chemical, and polyamides. Fillers, such as clays and talcs, may optionally be added to improve the bending stiffness of the thermoplastic materials.

Preferred organic polymers and homo-and copolymers of polyolefins include polyethylene, polypropylene and polybutylene homo- and copolymers. Thermoplastic materials that have elastomeric properties are typically called thermoplastic elastomeric materials. Thermoplastic elastomeric materials are generally defined as materials that act as though they were covalently crosslinked at ambient temperatures, exhibiting high resilience and low creep, yet process like thermoplastic nonelastomers and flow when heated above their softening point. Thermoplastic elastomeric materials useful in the ink receptive articles include, for example, linear, radial, star, and tapered block copolymers (e.g., styrene-isoprene block copolymers, styrene-(ethylene-butylene) block copolymers, styrene-(ethylene-propylene-) block copolymers, and styrene-butadiene block copolymers); polyetheresters such as those available under the trade designation HYTREL from E. I. DuPont de Nemours, Inc.; elastomeric ethylene-propylene copolymers; thermoplastic elastomeric polyurethanes such as those available under the trade designation MORTHANE from Morton International, Inc., Chicago, Ill.; polyvinylethers; polyalphaolefin-based thermoplastic elastomeric materials such as those represented by the formula $(CH_2CHR)_x$ where R is an alkyl group containing 2 to 10 carbon atoms, and polyalphaolefins based on metallocene catalysis such as AFFINITY, ethylene/polyalphaolefin copolymer available from Dow Plastics Co., Midland, Mich. In this application the term alphaolefin means an olefin having three or more carbon atoms and having a $—CH{=}CH_2$ group.

The foam layers 218, 220 of the multilayer ink receptive article in FIG. 3 are preferably oriented, high melt-strength polypropylene foams such as those described in US 2003/0232210. The foam layers 218, 220 may be prepared by using a foamable mixture including a major amount of a high melt-strength polypropylene and a minor amount of second polymer component including a semicrystalline or amorphous thermoplastic polymer. Polymer mixtures including a high melt-strength polypropylene and two or more added polymers may also be used.

The high melt strength polypropylene useful in the foam layers 218, 220 includes homo- and copolymers containing 50 weight percent or more propylene monomer units, preferably at least 70 weight percent, and has melt strength in the range of 25 to 60 cN at 190° C. Melt strength may be conveniently measured using an extensional rheometer by extruding the polymer through a 2.1 mm diameter capillary having a length of 41.9 mm at 190° C. and at a rate of 0.030 cc/sec; the strand is then stretched at a constant rate while measuring the force to stretch at a particular elongation. Preferably the melt strength of the polypropylene is in the range of 30 to 55 cN, as described in WO 99/61520. The melt strength of linear or straight chain polymers, such as conventional isotactic polypropylene, decreases rapidly with temperature. In contrast, the melt strength of highly branched polypropylenes does not decrease rapidly with temperature. Useful polypropylene resins are those that are branched or crosslinked. Such high melt strength polypropylenes may be prepared by methods generally known in the art. Reference may be made to U.S. Pat. No. 4,916,198 (Scheve et al) which describes a high melt strength polypropylene having a strain-hardening elongational viscosity prepared by irradiation of linear propylene in a controlled oxygen environment. Other useful methods include those in which compounds are added to the molten polypropylene to introduce branching and/or crosslinking such as those methods described in U.S. Pat. No. 4,714,716 (Park), WO 99/36466 (Moad, et al.) and WO 00/00520 (Borve et al.). High melt strength polypropylene may also be prepared by irradiation of the resin as described in U.S. Pat. No. 5,605,936 (Denicola et al.). Still other useful methods include forming a bipolar molecular weight distribution as described in J. I. Raukola, *A New Technology To Manufacture Polypropylene Foam Sheet And Biaxially Oriented Foam Film*, VTT Publications 361, Technical Research Center of Finland, 1998 and in U.S. Pat. No. 4,940,736 (Alteepping and Nebe), incorporated herein by reference.

The foamable polypropylene may be made solely of propylene homopolymer or may include a copolymer having 50 wt % or more propylene monomer content. Further, the foamable propylene may include a mixture or blend of propylene homopolymers or copolymers with a homo- or copolymer other than propylene homo- or copolymers.

Particularly useful propylene copolymers are those of propylene and one or more non-propylenic monomers. Propylene copolymers include random, block, and grafted copolymers of propylene and olefin monomers selected from ethylene, C3-C8 alphaolefins and C4-C10 dienes. Propylene copolymers may also include terpolymers of propylene and alphaolefins selected from the group consisting of C3-C8 alphaolefins, wherein the alphaolefin content of such terpolymers is preferably less than 45 wt %. The C3-C8 alphaolefins include 1-butene, isobutylene, 1-pentene, 3-methyl-1-butene, 1-hexene, 3,4-dimethyl-1-butene, 1-heptene, 3-methyl-1-hexene, and the like. Examples of C4-C10 dienes include 1,3-butadiene, 1,4-pentadiene, isoprene, 1,5-hexadiene, 2,3-dimethyl hexadiene and the like.

Minor amounts (less than 50 percent by weight) of other semicrystalline polymers that may be added to the high melt strength polypropylene in the foamable composition include high, medium, low and linear low density polyethylene, fluoropolymers, poly(1-butene), ethylene/acrylic acid copolymer, ethylene/vinyl acetate copolymer, ethylene/propylene copolymer, styrene/butadiene copolymer, ethylene/styrene copolymer, ethylene/ethyl acrylate copolymer, ionomers and thermoplastic elastomers such as styrene/ethylene/butylene/styrene (SEBS), and ethylene/propylene/diene copolymer (EPDM).

Minor amounts (less than 50 percent by weight) of amorphous polymers may be added to the high melt strength polypropylene. Suitable amorphous polymers include, e.g., polystyrenes, polycarbonates, polyacrylics, polymethacrylics, elastomers, such as styrenic block copolymers, e.g., styrene-isoprene-styrene (SIS), styrene-ethylene/butylene-styrene block copolymers (SEBS), polybutadiene, polyisoprene, polychloroprene, random and block copolymers of styrene and dienes (e.g., styrene-butadiene rubber (SBR)), ethylene-propylene-diene monomer rubber, natural rubber, ethylene propylene rubber, polyethylene-terephthalate (PETG). Other examples of amorphous polymers include, e.g., polystyrene-polyethylene copolymers, polyvinylcyclohexane, polyacrylonitrile, polyvinyl chloride, thermoplastic polyurethanes, aromatic epoxies, amorphous polyesters, amorphous polyamides, acrylonitrile-butadiene-styrene (ABS) copolymers, polyphenylene oxide alloys, high impact polystyrene, polystyrene copolymers, polymethylmethacrylate (PMMA), fluorinated elastomers, polydimethyl siloxane, polyetherimides, amorphous fluoropolymers, amorphous polyolefins, polyphenylene oxide, polyphenylene oxide-polystyrene alloys, copolymers containing at least one amorphous component, and mixtures thereof.

In addition to the high melt strength polypropylene, the foam layer may contain other added components such as dyes, particulate materials, a colorant, an ultraviolet absorbing material, inorganic additives, and the like. Useful inorganic additives include $TiO_2$, $CaCO_3$, or high aspect ratio fillers such as wollastonite glass fibers and mica. The oriented, high melt-strength polypropylene foam may be prepared by the steps of:

(1) mixing at least one high melt strength polypropylene and at least one blowing agent in an apparatus having an exit shaping orifice at a temperature and pressure sufficient to form a melt mixture wherein the blowing agent is uniformly distributed throughout the polypropylene;

(2) reducing the temperature of the melt mixture at the exit of the apparatus to an exit temperature that is no more than 30° C. above the melt temperature of the neat polypropylene while maintaining the melt mixture at a pressure sufficient to prevent foaming;

(3) passing the mixture through the exit shaping orifice and exposing the mixture to atmospheric pressure, whereby the blowing agent expands causing cell formation resulting in foam formation, and (4) orienting the foam.

The foams thus produced have an average cell sizes less than 100 μm, and advantageously may provide foams having average cell sizes less than 50 μm, prior to the orientation step. Additionally the foams produced have a closed cell content of 70 percent or greater. As result of extrusion, and subsequent orientation, the original spherical cells may be elongated in the machine direction to assume an oblate ellipsoidal configuration. An extrusion process using a single-screw, double-screw or tandem extrusion system may prepare the foams for the foam layers. This process involves mixing one or more high melt strength propylene polymers (and any optional polymers to form a propylene polymer blend) with a blowing agent, e.g., a physical or chemical blowing agent, and heating to form a melt mixture. The temperature and pressure conditions in the extrusion system are preferably sufficient to maintain the polymeric material and blowing agent as a homogeneous solution or dispersion. Preferably, the polymeric materials are foamed at no more than 30° C. above the melting temperature of the neat polypropylene thereby producing desirable properties such as uniform and/or small cell sizes.

When a chemical blowing agent is used, the blowing agent is added to the neat polymer, mixed, heated to a temperature above the $T_m$ of the polypropylene (within the extruder) to ensure intimate mixing and further heated to the activation temperature of the chemical blowing agent, resulting in decomposition of the blowing agent. The temperature and pressure of the system are controlled to maintain substantially a single phase. The gas formed on activation is substantially dissolved or dispersed in the melt mixture. The resulting single-phase mixture is cooled to a temperature no more than 30° C. above the melting temperature of the neat polymer, while the pressure is maintained at or above 1000 psi (6.9 MPa), by passing the mixture through a cooling zone(s) in the extruder prior to the exit/shaping die. Generally the chemical blowing agent is dry blended with the neat polymer prior to introduction to the extruder, such as in a mixing hopper.

With either a chemical or physical blowing agent, as the melt mixture exits the extruder through a shaping die, it is exposed to the much lower atmospheric pressure causing the blowing agent (or its decomposition products) to expand. This causes cell formation resulting in foaming of the melt mixture. When the melt mixture exit temperature is at or below 30° C. above the $T_m$ of the neat polypropylene, the increase in $T_m$ of the polymer as the blowing agent comes out of the solution causes crystallization of the polypropylene, which in turn arrests the growth and coalescense of the foam cells within seconds or, most typically, a fraction of a second. This preferably results in the formation of small and uniform voids in the polymeric material. When the exit temperature is no more than 30° C. above the $T_m$ of the neat polypropylene, the extensional viscosity of the polymer increases as the blowing agent comes out of the solution and the polypropylene rapidly crystallizes. When a high melt strength polypropylene is used, the extensional thickening behavior is especially pronounced. These factors arrest the growth and coalescense of the foam cells within seconds or, most typically, a fraction of a second. Preferably, under these conditions, the formation of small and uniform cells in the polymeric material occurs. When exit temperatures are in excess of 30° C. above the $T_m$ of the neat polymer, cooling of the polymeric material may take longer, resulting in non-uniform, un-arrested cell growth. In addition to the increase in $T_m$, adiabatic cooling of the foam may occur as the blowing agent expands.

Either a physical or chemical blowing agent may plasticize, i.e., lower the $T_m$ and $T_g$ of, the polymeric material. With the addition of a blowing agent, the melt mixture may be processed and foamed at temperatures considerably lower than otherwise might be required, and in some cases may be processed below the melt temperature of the high melt strength polypropylene. The lower temperature can allow the foam to cool and stabilize i.e., reach a point of sufficient solidification to arrest further cell growth and produce smaller and more uniform cell sizes.

Chemical blowing agents are added to the polymer at a temperature below that of the decomposition temperature of the blowing agent, and are typically added to the polymer feed at room temperature prior to introduction to the extruder. The blowing agent is then mixed to distribute it throughout the polymer in un-decomposed form, above the melt temperature of the polypropylene, but below the activation temperature of the chemical blowing agent. Once dispersed, the chemical blowing agent may be activated by heating the mixture to a temperature above its decomposition temperature of the agent. Decomposition of the blowing agent liberates gas, such as $N_2$, $CO_2$ and/or water, yet cell formation is restrained by the temperature and pressure of the system. Useful chemical blowing agents typically decompose at a temperature of 140° C. or above and may include decomposition aides. Blends of blowing agents may be used.

Examples of such materials include synthetic azo-, carbonate-, and hydrazide-based molecules, including azodicarbonamide, azodiisobutyronitrile, benzenesulfonhydrazide, 4,4-oxybenzene sulfonyl-semicarbazide, p-toluene sulfonyl semi-carbazide, barium azodicarboxylate, N,N'-dimethyl-N, N'-dinitrosoterephthalamide and trihydrazino triazine. Specific examples of these materials are Celogen OT (4,4' oxybisbenzenesulfonylhydrazide), Hydrocerol BIF (preparations of carbonate compounds and polycarbonic acids), Celogen AZ (azodicarbonamide) and Celogen RA (p-toluenesulfonyl semicarbazide). Other chemical blowing agents include endothermic reactive materials such as sodium bicarbonate/citric acid bends that release carbon dioxide. Specific examples include products available from Reedy International Corp. under the trade designation SAFOAM.

The amount of blowing agent incorporated into the foamable polymer mixture is chosen to yield a foam having a void content in excess of 10%, more preferably in excess of 20%, as measured by density reduction. Generally, greater foam void content reduces the foam density, weight and material costs for subsequent end uses.

A single stage extrusion apparatus can be used to make the foams, and is the preferred process for use with chemical blowing agents. A twin-screw extruder may be used to form a melt mixture of the polypropylene and blowing agent, although it will be understood that a single screw extruder may also be used. The polypropylene is introduced into an extruder by means of a hopper. Chemical blowing agents are typically added with the polymer but may be added further downstream. A physical blowing agent may be added using fluid handling means at a location downstream from a point at which the polymer has melted.

When a chemical blowing agent is used, an intermediate zone is generally maintained at an elevated temperature sufficient to initiate the chemical blowing agent, followed by subsequent cooler zones. The temperature of the initial zone(s) of the extruder must be sufficient to melt the polypropylene and provide a homogenous melt mixture with the blowing agent(s). The final zone or zones of the extruder are set to achieve the desired extrudate exit temperature. Using a single stage extrusion process to produce a homogeneous foamable mixture requires mixing and transitioning from an operating temperature and pressure to an exit temperature and pressure over a shorter distance. To achieve a suitable melt mix, approximately the first half of the extruder screw may have mixing and conveying elements which knead the polymer and move it through the extruder. The second half of the screw may have distributive mixing elements to mix the polymer material and blowing agent into a homogeneous mixture while cooling. The operating and exit pressures (and temperatures) should be sufficient to prevent the blowing agent from causing cell formation in the extruder. The operating temperature is preferably sufficient to melt the polymer materials, while the last zone or zones of the extruder are preferably at a temperature that will bring the extrudate to the exit temperature.

At the exit end of the extruder, the foamable, extrudable composition is metered into a die having a shaping exit orifice. In general, as the blowing agent separates from the melt mixture, its plasticizing effect on the polymeric material decreases and the shear viscosity and elastic modulus of the polymeric material increases. The shear viscosity increase is much sharper at the $T_m$ than at the $T_g$, making the choice of foaming temperatures for semicrystalline polymers much more stringent than for amorphous polymers. As the temperature of the polymeric material approaches the $T_m$ of the neat polymer and becomes more viscous, the cells cannot as easily expand or coalesce. As the foam material cools further, it solidifies in the general shape of the exit-shaping orifice of the die.

The blowing agent concentrations, exit pressure, and exit temperature can have a significant effect on the properties of the resulting foams including foam density, cell size, and distribution of cell sizes. In general, the lower the exit temperature, the more uniform, and smaller the cell sizes of the foamed material. This is because at lower exit temperatures, the extensional viscosity is higher, yielding slower cell growth. Extruding the material at lower than normal extrusion temperatures, i.e. no more than 30° C. above the $T_m$ of the neat polymeric material, produces foams with small, uniform cell sizes. In general, as the melt mixture exits the die, it is preferable to have a large pressure drop over a short distance. Keeping the solution at a relatively high pressure until it exits the die helps to form uniform cell sizes. Maintaining a large pressure drop between the exit pressure and ambient pressure can also contribute to the quick foaming of a melt mixture. The lower limit for forming a foam with uniform cells will depend on the particular blowing agent/polymer system being used. In general, for the high melt strength polypropylene useful in the invention, the lower exit pressure limit for forming acceptably uniform cells is approximately 7 MPa (1000 psi), preferably 10 MPa (1500 psi), more preferably 14 MPa (2000 psi). The smallest cell sizes may be produced at low exit temperatures and high blowing agent concentrations. However at any given temperature and pressure, there is a blowing agent concentration at and above which polydispersity will increase because the polymer becomes supersaturated with blowing agent and a two phase system is formed.

The optimum exit temperature, exit pressure, and blowing agent concentration for a particular melt mixture will depend on a number of factors such as the type and amount of polymer(s) used; the physical properties of the polymers, including viscosity; the mutual solubility of the polymer(s) and the blowing agent; the type and amount of additives used; the thickness of the foam to be produced; the desired density and cell size; and whether the foam will be coextruded with another foam or an unfoamed material; and the die gap and die orifice design.

Further details regarding the preparation of the high melt strength oriented foams may be found in Assignee's published application WO02/00412.

To optimize the physical properties of the foam, the polymer chains should preferably be oriented along at least one major axis (uniaxial), and may further be oriented along two major axes (biaxial). The degree of molecular orientation is generally defined by the draw ratio, that is, the ratio of the final length to the original length. Upon orientation, greater crystallinity is imparted to the polypropylene component of the foam and the dimensions of the foam cells change. Typical cells have major directions X and Y, proportional to the degree of orientation in the machine and transverse direction respectively. A minor direction Z, normal to the plane of the foam, remains substantially the same as (or may be moderately less than) the cross-sectional dimension of the cell prior to orientation and therefore the density of the foam decreases with orientation. Subsequent to orientation, the cells are generally oblate ellipsoidal in shape. The conditions for orientation are chosen such that the integrity of the foam is maintained. Thus, when stretching in the machine and/or transverse directions, the orientation temperature is chosen such that substantial tearing or fragmentation of the continuous phase is avoided and foam integrity is maintained. The foam is particularly vulnerable to tearing, cell rupture or even catastrophic failure if the orientation temperature is too low or the orientation ratio(s) is/are excessively high. Generally the foam is oriented at a temperature between the glass transition temperature and the melting temperature of the neat polypropylene. Preferably, the orientation temperature is above the alpha transition temperature of the neat polymer. Such temperature conditions permit optimum orientation in the X and Y directions without loss of foam integrity.

After orientation the cells are relatively planar in shape and have distinct boundaries. Cells are generally coplanar with the major surfaces of the foam, with major axes in the machine (X) and transverse (Y) directions (directions of orientation). The sizes of the cells are uniform and proportional to concentration of blowing agent, extrusion conditions and degree of orientation. The percentage of closed cells does not change significantly after orientation when using high melt strength polypropylene. In contrast, orientation of conventional polypropylene foam results in cell collapse and tearing of the foam, reducing the percentage of closed cells. Cell size, distribution and amount in the foam matrix may be determined by techniques such as scanning electron microscopy. Advantageously, the small cell sizes increase the opacity of the foam article, compared to foams having larger cell sizes, and opacifying agents may not be required.

In the orienting step, the foam is stretched in the machine direction and may be simultaneously or sequentially stretched in the transverse direction. The stretching conditions are chosen to increase the crystallinity of the polymer matrix and the void volume of the foam. It has been found that an oriented foam has significantly enhanced tensile strength, even with a relatively low density when compared to unoriented foams. The foam may be biaxially oriented by stretching in mutually perpendicular directions at a temperature above the alpha transition temperature and below the melting temperature of the polypropylene. Generally, the film is stretched in one direction first and then in a second direction perpendicular to the first. However, stretching may be effected in both directions simultaneously if desired. If biaxial orientation is desired, it is preferable to simultaneously orient the foam, rather than sequentially orient the foam along the two major axes. It has been found that simultaneous biaxial orientation provides improved physical properties such as tensile strength and tear resistance as compared to sequential biaxial orientation, and enables the preparation of a foam/non-foam multilayer construction where the non-foam layer is a lower melting polymer.

In a typical sequential orientation process, the film is stretched first in the direction of extrusion over a set of rotating rollers, and then is stretched in the direction transverse thereto by means of a tenter apparatus. Alternatively, foams may be stretched in both the machine and transverse directions in a tenter apparatus. Foams may be stretched in one or both directions 3 to 70 times total draw ratio (MD×CD). Generally greater orientation is achievable using foams of small cell size; foams having cell size of greater than 100 micrometers are not readily oriented more than 20 times, while foams having a cell size of 50 micrometers or less could be stretched up to 70 times total draw ratio. In addition foams with small average cell size exhibit greater tensile strength and elongation to break after stretching.

The temperature of the polymer foam during the first orientation (or stretching) step affects foam properties. Generally, the first orientation step is in the machine direction. Orientation temperature may be controlled by the temperature of heated rolls or by the addition of radiant energy, e.g., by infrared lamps, as is known in the art. A combination of temperature control methods may be utilized. Too low an orientation temperature may result in tearing the foam and rupturing of the cells. Too high an orientation temperature may cause cell collapse and adhesion to the rollers. Orientation is generally conducted at temperatures between the glass transition temperature and the melting temperature of the neat polypropylene, or at about 110-170° C., preferably 110-140° C. A second orientation, in a direction perpendicular to the first orientation may be desired. The temperature of such second orientation is generally similar to or higher than the temperature of the first orientation.

After the foam has been stretched it may be further processed. For example, the foam may be annealed or heat-set by subjecting the foam to a temperature sufficient to further crystallize the polypropylene while restraining the foam against retraction in both directions of stretching.

If desired, transparent or translucent regions may be imparted to the foam article or the multilayer article by embossing the article under heat and/or pressure by techniques known in the art. This embossing step is preferably performed on the oriented article after the application of the antistatic layer and the ink receptive coating layer. The embossing collapses the cells of the foam layer resulting in a transparent or translucent region that resists photocopying.

The final thickness of the foam will be determined in part by the extrusion thickness, the degree of orientation, and any additional processing. The process provides thinner foams than are generally achievable by prior art processes. Most foams are limited in thickness by the cell size. The small cell sizes (<50 μm) in combination with the orientation allows foam thickness of 1 to 100 mils (about 25 to 2500 μm) and greater opacity than larger cell foams. For security document applications, it is preferred that the thickness of the oriented foam layer(s) be from about 1 to 10 mils (about 25 to 259 μm), preferably 2 to 6 mils (about 50 to 150 μm).

The above processing techniques may be used to produce multilayer articles including at least one high melt strength polypropylene foam layer. The foams may be coextruded with materials having substantially higher or lower processing temperatures from that of the foam, while still obtaining the desired structures and cell sizes. It would be expected that exposing the foam to an adjacent hot polymer as it is extruded, might cause the foam cells, especially those in direct contact with the hotter material, to continue to grow and coalesce beyond their desired sizes or might cause the foam material to melt or collapse. The foams may be coextruded with a non-foam thermoplastic polymer layer, or may be coextruded with an ink-receptive layer.

The coextrusion process described herein may be used to make a foam material including two layers or more. A layered material or article may be produced by equipping a die with an appropriate feedblock, e.g., a multilayer feedblock, or by using a multi-vaned or multi-manifold die such as a 3-layer vane die available from Cloeren, Orange, Tex. Materials or articles having multiple adjacent foam layers may be made with foam layers including the same or different materials. Foam articles made according to the processes described herein may include one or more interior and/or exterior foam layer(s). In such a case, each extrudable material, including the high melt strength polypropylene foamable material, may be processed using one of the above-described extrusion methods wherein melt mixtures are fed to different inlets on a multi-layer feedblock, or multi-manifold die, and are brought together prior to exiting the die. The layers foam in generally the same manner as described above for the extrusion process. The multi-layer process can also be used to extrude the foam with other types of materials such as thermoplastic films and adhesives. When a multi-layered article is produced, it is preferable to form adjacent layers using materials having similar viscosities and which provide interlayer adhesion. When the multilayer article includes a foam layer and a film layer (on one or both surfaces), a greater degree of orientation and improved tensile properties may be possible, compared to a single layer foam.

Multilayer foam articles can also be prepared by laminating nonfoam layers to a foam layer, or by layering extruded foams as they exit their respective shaping orifices, with the use of some affixing means such as an adhesive. Useful laminated constructions include the high melt strength polypropylene foam layer with a thermoplastic film layer or a scrim layer, such as a non-woven layer. Other techniques that can be used include extrusion coating and inclusion coextrusion, which is described in U.S. Pat. No. 5,429,856, incorporated by reference. The multilayer article may be oriented as previously described.

The multilayer ink receptive article may also have an optional tie layer between adjacent foam layers, non-foam layers or ink-receptive layers to improve adherence between them (not shown in FIG. 1). Useful tie layers include extrudable polymers such as ethylene vinyl acetate polymers, and modified ethylene vinyl acetate polymers (modified with acid, acrylate, maleic anhydride, individually or in combinations). The tie layer may consist of these materials by themselves or as blends of these polymers with the thermoplastic polymer component. Use of tie layer polymers is well known in the art and varies depending on the composition of the two layers to be bonded. Tie layers for extrusion coating could include the same types of materials listed above and other materials such as polyethyleneimine which are commonly used to enhance the adhesion of extrusion coated layers. Tie layers can be applied to the foam layer, non-foam layer or ink absorptive layer by coextrusion, extrusion coating, laminating, or solvent coating processes.

Preferably, the foam layers of multilayer ink receptive articles range in thickness from about 20 to about 100 mils thick (about 500 to 2500 μm). Each non-foam layer of a multilayer substrate may range from 1 to 40 mils (about 25 to 1000 μm). If the non-foam layer is an internal stiffening layer, the thickness is generally from about 10 to 30 mils (about 250 to 750 μm). If the non-foam layer is an ink-receptive thermoplastic film layer, the thickness is generally from about 1 to 4 mils (about 25 to 100 μm). The overall thickness of a multilayer article may vary depending on the desired end use, but for security documents, the thickness is generally from about 20 to 120 mils (about 500 to 3050 μm), prior to orientation. The thickness (or volume fraction) of the multilayer article and the individual film and foam layers depend primarily on the end-use application and the desired composite mechanical properties of the multi-layered film. Such multilayer articles have a construction of at least 2 layers, preferably, at least 3 layers.

Depending on the polymers and additives chosen, thicknesses of the layers, and processing parameters used, the ink receptive articles will typically have different properties at different numbers of layers. That is, the same property (e.g., tensile strength, modulus, bending stiffness, tear resistance) may go through maximum at a different number of layers for two particular materials when compared to two other materials. For example, the foam layer generally has good tear propagation resistance, but poorer tear initiation resistance. Thermoplastic films generally have good tear initiation resistance, but poorer tear propagation resistance. A multilayer article having both a foam and thermoplastic film layer provides both desirable attributes. Each of the non-foam layers typically includes the same material or combination of materials, although they may include different materials or combinations of materials.

The multilayer films are typically prepared by melt processing (e.g., extruding). In a preferred method, the foam and non-foam layers are generally formed at the same time, joined while in a molten state, and cooled. That is, preferably, the layers are substantially simultaneously melt-processed, and more preferably, the layers are substantially simultaneously coextruded. Products formed in this way possess a unified construction and have a wide variety of useful, unique, and unexpected properties, which provide for a wide variety of useful, unique, and unexpected applications.

In a preferred method in accordance with the present invention, printed indicia, such a characters, images, text, logos, etc., are applied to the ink receptive layer utilizing a printing process. Many inks may be utilized in conjunction with the present invention including organic solvent-based inks, water-based inks, phase change inks, and radiation polymerizable inks. Depending on the printing technique used, preferred inks may include water-based inks. Inks utilizing various colorants may be utilized in conjunction with the present invention. Examples of colorants, which may be suitable in some applications, include dye-based colorants, and pigment based colorants. Examples of suitable printing methods include laser printing, gravure printing, offset printing, silk screen printing, electrostatic printing, intaglio and flexographic printing.

The ink-receptive article preferably includes one or more security features. Security features have been developed to authenticate security documents, and may be overt or covert. Overt security features include holograms and other diffractive optically variable images, transparent or translucent regions, embossed images, watermarks and color-shifting films or inks, while covert security features include images only visible under certain conditions such as inspection under light of a certain wavelength, polarized light, or retroreflected light. Even more sophisticated systems require specialized electronic equipment to inspect the document and verify its authenticity.

Suitable security features may include, for example, printed indicia or reverse printed indicia, or films such as color shifting films, metameric films, polarizing films, fluorescent films, luminescent films, phosphorescent films, pearlescent films, holographic films, reflective films, metallic films, and magnetic films. Additional examples of security features may include, for example, threads, particles or fibers, watermarks, embossments, and transparent and/or translucent regions. The security features may includes materials with optical properties such as, for example, liquid crystals, holograms, optical lenses, microlenses, Fresnel lenses, optical filters, polarizing filters, reflective elements, photochromic elements, thermochromic elements, Moiré patterns, and embossed images or other three dimensional elements. The security features may also include special inks such as, for example, color shifting inks, metameric inks, polarizing inks, fluorescent inks, luminescent inks, phosphorescent inks, pearlescent inks, holographic inks, reflective inks, metallic inks, and magnetic inks, or combinations thereof.

Examples of security features that may be suitable in some applications include a picture of a human face, serial numbers, a representation of a human fingerprint, a bar code, transparent regions, and a representation of a cardholder's signature and the like. One particularly useful security feature includes an embodiment wherein a colorant is added to a thermoplastic film layer in an embossed foam/film/foam construction. Normally, due to the opacity of the foam layers, the colorant in the film layer is not readily visible. However, on embossing one or both of the foam layers, a translucent region is created and the colored film is revealed.

In some embodiments, the security feature may be on a surface of the foam layer or the thermoplastic film layer, may be dispersed in the foam layer or the film layer, or may be laminated to the film layer or to the foam layer.

In some embodiments, the security feature may include a core embedded in the thermoplastic film layer, or a plurality of laterally spaced cores embedded in the thermoplastic film layer. The core may include a thermoplastic polymer with dyes or pigments, or may include particulate materials dissolved or dispersed therein. Suitable particulate materials include, for example, color shifting particles, metameric particles, polarizing particles, fluorescent particles, luminescent particles, phosphorescent particles, pearlescent particles, reflective particles, metallic particles, and magnetic particles, or combinations thereof.

In some embodiments, the security feature may be coextruded with the film layer or the foam layer using, for example, an inclusion coextrusion process.

In some embodiments, one or more security features in adjacent layers of the construction may be used in registration to provide a visual security feature.

Embossing can significantly reduce the light scattering from the, foam cell/polymer interfaces, leading to translucent or nearly transparent areas in the film layers and/or in the foam layers in the construction. Through the choice of embossing tooling, some areas containing indicia may remain unembossed (still substantially opaque), while other areas are substantially transparent, allowing verification in reflected or transmitted light. The transparency of the embossed indicia and the consistency of the light scattering in the unembossed regions are useful in determining that counterfeiting via the addition of a transparent film was not attempted. Other methods of reducing the light scattering of the foams are contemplated including vacuum, pressurized jets, peening, impingement with dot matrix print heads, and localized melting. Embossing of the article can provide a tactile security feature, which is desirable by the visually impaired.

In a foam/film/foam construction, the embossing may reveal the center film. This construction is particularly useful if the center film layer is a security film or a birefringent multilayer optical film. This may be particularly useful if the embossing process revealed some portions of the center film while leaving other regions unembossed. Another embodiment would include a center security film that provided different security features in the embossed and unembossed regions. For example, if the embossed region of the center security film provided one color in transmitted light while the unembossed region provided a different color in transmitted light, this two-fold security feature would be extremely difficult to replicate or counterfeit.

If desired, the article may be coated with a white opacifying coating and security printing inks may be used. Generally, an opacifying agent such as $TiO_2$ or $CaCO_3$ may be added to the ink-receptive coating. However, because the small foam cell size and scattering of incident light is naturally opacifying, additional opacifying agents may not be necessary. If desired, some regions may remain uncoated to allow for transparent or translucent regions of be embossed on the article, by the application of heat and/or pressure, which at least partially melts the foam layer and collapses the cells. The placement of the transparent region(s) may also be a security feature. Some of these transparent regions, or windows, may lack opacifying coatings on both sides, for viewing the transmitted light. Other windows may have no coating on one side, and a white or black coating on the opposite side.

Other security features may also be practiced, such as hot stamping of holograms (transparent or aluminum vapor coated), printing with color shifting and/or magnetic inks, and laser ablation to produce small holes that become apparent when held adjacent to a strong backlight.

EXAMPLES

Test Methods

The following test methods were used in the examples below.

Chemical Resistance Test Method:

18 mm squares of coated film or the coated and inked film were immersed in the designated chemical for 30 minutes. Swirling or stirring is used to maintain contact of the chemical with the coated film since the film floats. Upon removal, the sample is rubbed (lightly), and the coating removal is scored according to this table:

| | Condition | | | | |
|---|---|---|---|---|---|
| | All came off | >50% came off | <50% came off | Minor change | Unaffected |
| Score | 0 | 1 | 2 | 3 | 4 |

The chemicals typically tested include: ethanol, acetone, xylene, gasoline, 20% acetic acid, 5% HCl, 5% sulfuric acid, 5% sodium hypochlorite (bleach), 5% NaOH, hydrogen peroxide, diethylene glycol, tetrachloroethylene, and synthetic sweat (DIN 53160).

Without cross-linking, the chemical resistance of the water based coatings was relatively poor with ratings of 0 or 1 for most of the solvents. However, when the polymer is cross-linked, then the ratings increase to 3 and 4 in general.

Ink Coating Method:

Ink was coated onto the substrates using a Little Joe Offset Proving Press. Using the press, 0.2 ml of SICPA wet offset ink (red color) was added evenly over a 4 inch×6 inch area of the coated substrate.

Ink Receptivity Test Method:

After the oriented foam substrate was coated and inked, the sample was allowed to set for 30 seconds. The ink was then rubbed aggressively with a clean Kim Wipe (folded several times to find clean spots) for 30 seconds. The ink receptivity was then given a rating as described in the table below.

| | Condition | | | | |
|---|---|---|---|---|---|
| | All came off (<5% remains) | Most came off (>75%) | About 50% came off | Minor change | Unaffected |
| Score | 0 | 1 | 2 | 3 | 4 |

Static Dissipation Test Method:

A 3×5 inch sample of the coated substrate was charged, and charge dissipation time was measured. Static decay times were measured on an Electro-Tech Systems (Glenside, Pa.) Model 406C static decay meter. Film samples approximately five inches on a side were cut and mounted between the meter electrodes using magnets. The sample was charged to +/−5 kV, and the time for the charge to decay to 10% of its initial value was measured. Good static dissipation time was determined to be less than 0.1 seconds, and acceptable dissipation time was determined to be less than 1 second.

Friction Coefficient Measurement Test Method:

The static and dynamic coefficients of friction of the coated substrates were measured using ASTM COF test method D1894.

Ingredients and Materials

The table below depicts the trade designation, supplier, and supplier location for ingredients and materials used in the examples below.

| Generic Description | Trade Designation | Supplier (Location) |
|---|---|---|
| Matrix Polymer | | |
| Polyurethane Dispersion | "Neorez R-960" | DSM Neoresins (Wilmington, MA) |
| Acrylic Dispersion | "Neocryl XK-90" | DSM Neoresins (Wilmington, MA) |
| Acrylic Urethane Dispersion | "Neorez R-9699" | DSM Neoresins (Wilmington, MA) |
| Cross-linker | | |
| Aziridine | "CX-100" | DSM Neoresins (Wilmington, MA) |
| Surfactants | | |
| Non-ionic Surfactant | "Surfynol 104PA" | Air Products (Allentown, PA) |
| Non-ionic Surfactant | "Tergitol TMN-6" | Dow chemical Co. (Midland, MI) |
| Defoamer | | |
| Bubble Breaker | "Witco 3056A" | Witco Chem. Corp. (Houston, TX) |
| Inorganic Filler | | |
| Fumed silica | "Cabosil M-5" | Cabot Corp. (Billierica, MA) |
| Fumed silica | "Aerosil 130" | DegussaAG (Düsseldorf, Germany) |
| Porous silica beads | "Gasil 23F" | Ineos Silicas, Ltd, (Wannington, England) |
| Antistatic Agent | | |
| Conductive polymer | "Baytron P" | Bayer AG (Pittsburg, PA) |
| Vanadium pentoxide | "Vanadia" | 3M Corp. (St. Paul, MN) |
| Antiblocking Agent | | |
| Acrylic beads (10 μm) | "MX-1000" | Esprix Technologies (Sarasota, FL) |
| Slip Agent | "Neorez R-9649" | DSM Neoresins (Wilmington, MA) |

Substrate

In all the examples below, the substrate used was a nitrogen corona treated oriented foam substrate as described in US2003/0232210.

Cross-Linking Component Formulation Method:

The crosslinker referred to below as "Part B" was made by combining 76 parts ethyl alcohol, 22.8 parts CX-100 (aziridine cross-linker), and 1.2 parts Surfynol 104PA surfactant. All ingredients were combined in a beaker and mixed for 20 minutes under high shear.

Example 1

The composition described in Table 1 was prepared by combining all ingredients and mixing until well blended (for about one hour of high shear mixing).

TABLE 1

| Material | Material Description | Wet Parts | Dry Parts |
|---|---|---|---|
| Neorez R-960 | Polyurethane dispersion | 100 | 33 |
| Part B | Cross-linker | 11.6 | 2.5 |
| Cabosil M-5 | Fumed silica | 3.4 | 3.4 |
| Baytron P | Antistatic conductive polymer | 20 | 0.26 |
| Acrylic Beads (MX-1000) | Antiblock agent | 5.7 | 5.7 |
| DI water | diluent | 46 | 0 |
| Total | | 186.7 | 44.86 |

The above composition was coated on one side of the oriented foam substrate in a pilot plant. Reverse Gravure coating method was used. The dry coating thickness was approximately 10 μm. Oven temperature was set at 105° C. and the line speed was 16 meters per minute. The coating composition was diluted to give a new coating thickness of 6 micrometers on the other side of the oriented foam substrate. The same coating and drying conditions were used as when the first side was coated.

The static dissipation of the coated article was infinite indicating poor conductivity, and ink absorption rating was 3. In order to improve static dissipation one part Baytron P was added to 10 parts of the composition from Table 1. The mixture was coated onto the oriented foam substrate using Meyer rod #26 resulting in a dry coating thickness of about 10 μm. The static dissipation of the new coating was 0.01 seconds, and the COFs were 0.64 (static) and 0.50 (dynamic).

Example 2

The composition described in Table 2 was prepared by combining all ingredients and mixing until well blended (for about one hour of high shear mixing).

TABLE 2

| Material | Material Description | Wet Parts | Dry Parts |
|---|---|---|---|
| Neocryl XK-90 | Water based acrylic dispersion | 100 | 33 |
| Part B | cross-linker | 7.5 | 1.65 |
| Cabosil M-5 | Fumed silica | 3 | 3 |
| Gasil 23F | Antiblock agent/porous silica | 1.6 | 1.6 |
| Baytron P | Antistatic conductive polymer | 25 | 0.32 |
| Acrylic Beads (MX-1000) | Antiblock agent | 5.4 | 5.4 |
| DI Water | Diluent | 50 | |
| Total | | 192.5 | 44.97 |

The above composition was coated onto both side of the oriented foam substrate in a pilot plant. Reverse Gravure coating method was used. The dry coating thickness was approximately 10 μm. Oven temperature was set at 105° C. and the line speed was 16 meters per minute.

The static dissipation of the coated article was infinite indicating poor conductivity, and ink absorption rating was 2.

Chemical resistance of samples from Examples 1 and 2 were evaluated and rated in Table 3.

TABLE 3

Chemical Resistance Results for Examples 1 and 2

| Example | Acetone | Xylene | Gasoline | Sodium Hydroxide | Tetrachloro-ethylene |
|---|---|---|---|---|---|
| 1 (10 μm layer) | 4 | 4 | 4 | 4 | 4 |
| 1 (6 μm layer) | 2.5 | 2.5 | 2.5 | 4 | 2 |
| 2 | 3 | 3 | 3 | 4 | 4 |

Note that increasing the receptive layer thickness results in improved chemical resistance.

Example 3

The coatings described in Examples 1 and 2 were all bluish-gray in color, presumably due to the presence of the Baytron polymer. To eliminate or minimize the coating color while still maintaining good static dissipation, a two step coating method was used. First an antistatic composition containing 0.46% by dry weight Baytron P was prepared by mixing 5 parts R-960 Part A, 0.5 parts Part B, and 3 parts Baytron P. This composition was coated onto the oriented foam substrate using Meyer rod #3 giving a dry coating thickness of approximately 0.7 μm. The coating was dried in a 55° C. oven for 5 minutes. On this antistatic coating layer the ink receptive layer was coated, which included 10 parts R-960 part A, 1 part Part B, 0.4 parts Cabosil M-5, and 0.5 parts acrylic beads. The second coating without the Baytron was coated using Meyer rod #12 resulting in a dry coating thickness of approximately 6 μm. The coated substrate was almost white with a very slight blue tint. The static dissipation time was measured at 0.01 seconds. This result is unexpected since the antistatic polymer containing layer is buried below the surface of the substrate.

R-960 Part A was made by mixing 53.3 parts DI water, 33 parts R-960 aliphatic polyurethane, 16.5 parts NVP, and 1.6 parts triethylamine.

Example 4

The following water-based coatings were evaluated for ink absorption and solvent resistance. Table 4 below provides the compositions. The compositions were coated onto the oriented foam substrate using Meyer rod #26. The coatings were dried at 55° C. for 5 minutes. All three coatings had a rating of 2 for ink receptivity, and a rating ranging between 3 and 4 for chemical resistance.

TABLE 4

| Material | Composition 4A | Composition 4B | Composition 4C |
|---|---|---|---|
| R-960 | 10 parts | | |
| XK-90 | | 10 parts | |
| Part B | 1 parts | 1 parts | 1 parts |
| Acrylic Beads (MX-1000) | 0.7 parts | 0.7 parts | 0.7 parts |

TABLE 4-continued

| Material | Composition 4A | Composition 4B | Composition 4C |
|---|---|---|---|
| Aerosil 130 Fumed silica | 0.5 parts | 0.5 parts | 0.5 parts |
| R-9699 | | | 10 parts |

Example 5

The following coating compositions were prepared and coated onto the oriented foamed substrate using Meyer rod #26. The coatings were dried at 55° C. for 5 minutes. The coatings were evaluated for static dissipation as shown in Table 5 below.

TABLE 5

| Material | Composition 5A | Composition 5B |
|---|---|---|
| R-9699 | 10 parts | 10 parts |
| CX-100 | 0.1 parts | 0.1 parts |
| Baytron P | 5 parts | 2.5 parts |
| Antistatic properties | 0.011 seconds | 0.16 seconds |

Doubling the concentration of the conductive polymer in the coating composition resulted in significant reduction in the static charge dissipation time.

Example 6

The following water-based coatings were evaluated for ink absorption and friction. Table 6 below provides compositions and evaluation results. Meyer rod #26 was used to coat the compositions onto the oriented foam substrate. The coatings were dried for 5 minutes in a 55° C. oven.

TABLE 6

| Material | Composition 6A | Composition 6B | Composition 6C | Composition 6D |
|---|---|---|---|---|
| XK-90 | 20 parts | 20 parts | 20 parts | 20 parts |
| CX-100 | 0.4 parts | 0.4 parts | 0.4 parts | 0.4 parts |
| Cab-o-sil M-5 | 0.5 parts | 0.5 parts | 0.5 parts | 0.5 parts |
| Plastic beads | 0.8 parts | | | |
| R9649 (slip agent) | | 0.2 parts | 0.5 parts | 0.8 parts |
| Ink receptivity rating | 2 | 2 | 2 | 2 |
| Static COF | 0.66 | 0.6 | 0.5 | 0.6 |
| Dynamic COF | 0.57 | 0.55 | 0.5 | 0.55 |

Using small amount of slip agent in place of the plastic beads provided good friction. However, the slip agent does not function as a physical spacer to allow for quick drying of the ink.

Example 7

The composition described in Table 7 was prepared by combining all ingredients (except the defoamer) and mixing until well blended (for about one hour of high shear mixing). The defoamer was added dropwise until most of the foam generated during mixing subsided.

TABLE 7

| Material | Function | Wet Parts | Dry Parts |
|---|---|---|---|
| Neocryl XK-90 | Acrylic binder resin | 100 | 40 |
| Part B | Cross-linker | 13 | 3.1 |
| Cabosil M-5 | fumed silica filler | 4 | 4 |
| Acrylic Beads - MX-1000 | Antiblocking agent | 6 | 6 |
| Isopropanol | wetting and flow | 1 | 0 |
| Witco 3056A | defoamer | few drops | 0 |
| DI water | diluent | 56 | 0 |
| Total | | 180 | 53.1 |

The above composition was coated onto one side of the oriented foam substrate using Reverse Gravure coating method. Dry coating thickness was measured at 9 μm. Oven temperature was set at 105° C. and the line speed was 16 meters per minute.

The composition described in Table 8 was prepared by combining all ingredients (except the defoamer) and mixing until well blended (for about one hour of high shear mixing). The defoamer was added dropwise until most of the foam generated during mixing subsided.

TABLE 8

| Antistatic layer composition | | | |
|---|---|---|---|
| Material | Function | Wet Parts | Dry Parts |
| Baytron P | Conductive polymer | 40 | 0.5 |
| Neocryl XK-90 | Acrylic binder resin | 100 | 40 |
| Part B | Cross-linker | 13 | 3.1 |
| Cabosil M-5 | fumed silica filler | 4 | 4 |
| Acrylic Beads - MX-1000 | friction | 6 | 6 |
| Isopropanol | Wetting and flow | 1 | 0 |
| Witco 3056A | defoamer | few drops | 0 |
| DI water | diluent | 88 | 0 |
| Total | | 252 | 53.6 |

The second side of the oriented foam substrate was coated with the composition described in Table 8 using Reverse Gravure coating method. Dry coating thickness was measured at 7 μm. Oven temperature was set at 105° C. and the line speed was 16 meters per minute.

Static decay time was measured at 0.48 seconds, and the COFs were 0.45 (static) and 0.50 (dynamic).

Chemical resistance was measured using Acetone, Xylene, sodium hydroxide, gasoline, and tetrachloroethylene. A rating of 4 was obtained with all solvents indicating excellent chemical resistance.

Example 8

The composition described in Table 9 was prepared by combining all ingredients (except the defoamer) and mixing until well blended (for about one hour of high shear mixing). The defoamer was added dropwise until most of the foam generated during mixing subsided.

TABLE 9

| Antistatic layer composition | | | |
|---|---|---|---|
| Material | Function | Wet Parts | Dry Parts |
| Baytron P | Conductive polymer | 50 | 0.65 |
| Neocryl XK-90 | Acrylic binder resin | 100 | 40 |
| Part B | Cross-linker | 13 | 3.1 |
| Cabosil M-5 | Fumed silica filler | 4 | 4 |

TABLE 9-continued

| Antistatic layer composition | | | |
|---|---|---|---|
| Material | Function | Wet Parts | Dry Parts |
| Acrylic Beads - MX-1000 | friction | 6 | 6 |
| Isopropanol | wetting and flow | 1 | 0 |
| Witco 3056A | defoamer | few drops | 0 |
| DI water | diluent | 56 | 0 |
| Total | | 230 | 53.75 |

The composition described in Table 9 was coated on one side of the oriented foam substrate using Reverse Gravure coating method. Dry coating thickness was measured at 5 μm. Oven temperature was set at 105° C. and the line speed was 16 meters per minute.

The second side of the oriented foam substrate was coated using the composition described in Table 7 from Example 7. Reverse Gravure coating method was used. Dry coating thickness was measured at 15 μm. Oven temperature was set at 105° C. and the line speed was 16 meters per minute.

Static decay time was measured at 0.82 seconds, and the COFs were 0.65 (static) and 0.65 (dynamic).

Chemical resistance was measured using Acetone, Xylene, sodium hydroxide, gasoline, and tetrachloroethylene. A rating of 4 was obtained with all solvents indicating excellent chemical resistance.

Example 9

The composition described in Table 10 was prepared by combining all ingredients and mixing until well blended (for about one hour of high shear mixing).

TABLE 10

| Material | Function | Wet Parts | Dry Parts |
|---|---|---|---|
| Neorez R-960 | Binder resin | 100 | 33 |
| Part B | Cross linker | 13 | 3.1 |
| Cabosil M-5 | fumed silica filler | 4 | 4 |
| Acrylic Beads - MX-1000 | friction | 6 | 6 |
| DI water | diluent | 42 | 0 |
| | | 165 | 46.1 |

The above composition was coated onto one side of the oriented foam substrate using Reverse Gravure coating method. Dry coating thickness was measured at 8 μm. Oven temperature was set at 105° C. and the line speed was 16 meters per minute.

The composition described in Table 11 was prepared by combining all ingredients and mixing until well blended (for about one hour of high shear mixing).

TABLE 11

| Material | Function | Wet Parts | Dry Parts |
|---|---|---|---|
| Baytron P | Conductive polymer (Antistat) | 40 | 0.5 |
| Neorez R-960 | Binder resin | 100 | 33 |
| Part B | Cross linker | 13 | 3.1 |
| Cabosil M-5 | fumed silica filler | 4 | 4 |
| Acrylic Beads - MX-1000 | Friction | 6 | 6 |
| DI water | Diluent | 67 | 0 |
| Total | | 230 | 46.6 |

The second side of the oriented foam substrate was coated using the composition described in Table 11. The reverse Gravure coating method was used. Dry coating thickness was measured at 7 μm. Oven temperature was set at 105° C. and the line speed was 16 meters per minute.

Static decay time was measured at 0.03 seconds, and the COFs were 0.4 (static) and 0.4 (dynamic).

Chemical resistance was measured using Acetone, Xylene, sodium hydroxide, gasoline, and tetrachloroethylene. A rating of 4 was obtained with all solvents indicating excellent chemical resistance.

Example 10

The composition described in Table 12 was prepared by combining all ingredients and mixing gently by hand until well blended.

TABLE 12

Vanadia Formulation

| Material | function | Wet Parts | Dry Parts |
|---|---|---|---|
| Vanadia (1% in water) | antistat | 100 | 1 |
| Tergitol TMN-6 (90%) in water | surfactant | 4 | 3.6 |
| DI water | diluent | 4140 | 0 |
| TOTAL | | 4244 | 4.6 |

The above composition was coated onto one side of the oriented foam substrate using Meyer rod #6 with wet coating thickness of approximately 8 micrometers. Dry coating thickness was estimated at approximately a few nanometers. The coated article was dried for 5 minutes in a 55° C. oven.

Both sides of the vanadia coated substrate were coated with the composition described in Table 10 from example 9. Meyer rod #26 was used, and the coated substrate was dried for 5 minutes in a 55° C. oven.

Static decay time was measured at 0.01 seconds, and the COFs were 0.4 (static) and 0.4 (dynamic).

Chemical resistance was measured using Acetone, Xylene, sodium hydroxide, gasoline, and tetrachloroethylene. A rating of 4 was obtained with all solvents indicating excellent chemical resistance.

Example 11

The composition described in Table 13 was prepared by combining all ingredients (except the defoamer) and mixing until well blended (for about one hour of high shear mixing). The defoamer was added dropwise until most of the foam generated during mixing subsided.

TABLE 13

| Material | Function | Wet Parts | Dry Parts |
|---|---|---|---|
| Neocryl XK-90 | Acrylic Binder resin | 100 | 40 |
| Part B | Cross linker | 13 | 3.1 |
| Cabosil M-5 | fumed silica filler | 4 | 4 |
| Acrylic Beads - MX-1000 | Friction | 6 | 6 |
| Isopropanol | wetting and flow | 1 | 0 |
| Witco 3056A | Defoamer | few drops | 0 |
| DI water | Diluent | 140 | 0 |
| Total | | 264 | 53.1 |

The vanadia based antistatic layer composition described in Table 12 from Example 10 was coated onto one side of the oriented foam substrate using Meyer rod #6 with wet coating thickness of approximately 8 micrometers. Dry coating thickness was estimated at approximately a few nanometers. The coated article was dried for 5 minutes in a 55° C. oven.

Both sides of the vanadia coated substrate were coated with the composition described in Table 13 using Meyer rod #26 was used, and the coated substrate was dried for 5 minutes in a 55° C. oven.

Static decay time was measured at 0.01 seconds, and the COFs were 0.42 (static) and 0.48 (dynamic).

Chemical resistance was measured using Acetone, Xylene, sodium hydroxide, gasoline, and tetrachloroethylene. A rating of 4 was obtained with all solvents indicating excellent chemical resistance.

Comparative Example A

The uncoated oriented foam substrate was printed with wet offset ink. Antistatic properties of the substrate were poor with infinite static dissipation time. Ink receptivity score was 0 and friction was very high (evaluated qualitatively since quantitative tests could not be performed due to the high static of the substrate).

Comparative Example B

A coating composition including 10 parts R-960, 1 part Part B, and 2 parts DI water was prepared. The composition was coated onto the oriented foam substrate using Meyer rod #26 to give a dry coating thickness of approximately 9 micrometers (μm). The coated substrate was dried for 5 minutes in a 55° C. oven, then printed with wet offset ink. Antistatic properties of the substrate were poor with infinite static dissipation time. Ink receptivity score was 1 and friction was very high (evaluated qualitatively since quantitative tests could not be performed due to the high static of the substrate).

Various embodiments of the invention have been described. These and other embodiments are within the scope of the following claims.

What is claimed is:

1. An ink receptive article, comprising:

a substrate having on at least a portion of a major surface thereof an antistatic layer, wherein the antistatic layer is selected from the group consisting of vanadium pentoxide, antimony oxide, lithium salts in combination with a PEG functionalized material, quaternary ammonium salts and a PEDT/PSS (poly(3,4-ethylenedioxythiophene) poly(styrenesulfonate)) conductive polymer; and an ink receptive layer on at least a portion of the antistatic layer, wherein the ink receptive layer comprises:

a major component of a crosslinked urethane polymer and copolymers and blends thereof with acrylic polymers, and about 5% to about 20% by weight of an ink absorber selected from the group consisting of metal oxides and silicas, and wherein the ink receptive layer further comprises a printed indicia comprising an organic solvent-based ink.

2. The ink receptive article of claim 1, wherein a crosslinker is present at 0.1 wt % to 10 wt % of the amount of polymer in the ink receptive layer.

3. The ink receptive article of claim 1, wherein a crosslinker is present at 0.3 wt % to 3 wt % of the amount of polymer in the ink receptive layer.

4. The ink receptive article of claim 1, wherein the ink receptive layer further comprises a crosslinker selected from the group consisting of aziridines, carbodiimides, and melamines.

5. The ink receptive article of claim 1, wherein the ink receptive coating layer further comprises 20-50% by weight of an antistatic agent.

6. The ink receptive article of claim 1, wherein the substrate comprises an antistatic agent.

7. The ink receptive article of claim 1, wherein the ink receptive coating layer further comprises 2-20% by weight of a material selected from the group consisting of glass microspheres, polymer beads and porous silica beads.

8. The ink receptive article of claim 1, wherein the substrate is selected from polymeric films, foils and oriented foams.

9. The ink receptive article of claim 1, further comprising an intermediate layer between the antistatic layer and the substrate.

10. The ink receptive article of claim 1, further comprising an intermediate layer between the antistatic layer and the ink receptive coating layer.

11. An ink receptive article comprising a substrate comprising an oriented foam layer, wherein the substrate has an antistatic layer on at least a portion of a major surface thereof, the antistatic layer comprising a static dissipating compound selected from the group consisting of vanadium pentoxide, antimony oxide, and a PEDT/PSS (poly(3,4-ethylenedioxythiophene) poly(styrenesulfonate)) conductive polymer, and an ink receptive layer on a least a portion of the antistatic layer, wherein the ink receptive layer comprises a major component of at least one crosslinked urethane polymer and about 5% to about 20% by weight of an ink absorber selected from the group consisting of metal oxides and silicas, and wherein the ink receptive layer further comprises a printed indicia comprising an organic solvent-based ink.

12. The article of claim 11, wherein the substrate further comprises at least one non-foam layer.

13. The article of claim 12, wherein the non-foam layer comprises a thermoplastic film.

14. The article of claim 11, wherein the substrate comprises two oriented polypropylene foam layers and a thermoplastic film layer disposed therebetween.

15. The article of claim 11, wherein the substrate further comprises an antistatic agent.

16. The article of claim 11, wherein the ink receptive coating layer comprises an antistatic agent.

17. A security document comprising the ink receptive article of claim 11.

18. The article of claim 11, wherein the substrate comprises at least one security feature.

19. The article of claim 18, wherein the security feature is an embossment.

20. The article of claim 19, wherein the embossment provides a substantially transparent region in the substrate.

21. The article of claim 14, further comprising a security feature in the thermoplastic film layer.

22. The article of claim 14, further comprising a security feature in the foam layer.

23. The article of claim 18, wherein the security feature is selected from printed indicia, reverse printing, a film selected from color shifting, metameric, polarizing, fluorescent, luminescent, phosphorescent, pearlescent, holographic, reflective, metallic, and magnetic films; threads, particles or fibers; watermarks, embossments, transparent or translucent regions, liquid crystals; holograms, optical lenses, microlenses, Fresnel lenses, optical filters, polarizing filters, and reflective features; photochromic features, thermochromic features, liquid crystals, Moiré patterns, embossed images; inks selected from color-shifting, metameric, polarizing, fluorescent, phosphorescent, pearlescent or magnetic inks; and combinations of the above.

24. The article of claim 18, wherein the security feature is revealed through a substantially transparent region in the foam layer.

25. The article of claim 18, wherein the article comprises at least two security features which, in registration, provide a visual security feature.

26. The article of claim 25, wherein said security feature is one of a polarizing feature and a Moiré pattern.

27. The article of claim 18, wherein the security feature comprises at least one core embedded in the thermoplastic film layer.

28. The article of claim 18, wherein the security feature comprises a plurality of laterally spaced cores embedded in the thermoplastic film layer.

29. The article of claim 27, wherein the core comprises a thermoplastic polymer with dyes or pigments, or color shifting, polarizing, fluorescent, luminescent, phosphorescent, reflective, metallic, or magnetic particles dissolved or dispersed therein.

30. The article of claim 29, wherein the thermoplastic polymer comprises colored, phosphorescent, pearlescent or fluorescent particles dispersed therein.

31. The article of claim 27, wherein the security feature is coextruded with the foam layer by an inclusion coextrusion process.

32. The article of claim 27, wherein the security feature is coextruded with the film layer by an inclusion coextrusion process.

33. The article of claim 13, wherein the article comprises two high melt-strength, oriented polymer foam layers and a thermoplastic film layer disposed therebetween.

34. The article of claim 13, wherein the thermoplastic film layer is coextruded with the foam layer.

35. The article of claim 13, wherein the thermoplastic film layer is laminated to the foam layer.

36. The article of claim 13, wherein the article comprises a thermoplastic film layer and said high melt strength foam layer, and wherein the article has a bending stiffness of at least 40 Newtons.

37. The article of claim 11, wherein the foam layer comprises a polypropylene comprising homo- and copolymers containing 50 weight percent or more propylene monomer units.

38. The article of claim 37, wherein the polypropylene copolymers are selected from random, block, and grafted copolymers of propylene and an $\alpha$-olefin selected from the group consisting of C3-C8$\alpha$-olefins and C4-C10 dienes.

39. The article of claim 37, wherein the polypropylene is a high melt-strength polypropylene.

40. The article of claim 39, wherein the high melt-strength polypropylene has a melt strength of 25 to 60 cN at 190° C.

41. The article of claim 39, wherein the high melt strength polypropylene comprises a blend of a major amount of the high melt strength polypropylene and a minor amount of an additional semicrystalline or amorphous polymer.

42. The article of claim 11, wherein foam layer is biaxially oriented.

43. The article of claim 11, wherein the article comprises a security feature on a surface of the foam layer.

44. The article of claim 11, wherein the article comprises a security feature dispersed in said foam layer.

45. The article of claim 18, wherein the security feature is laminated to the foam layer.

46. The article of claim 45, wherein said laminated security feature is a birefringent multilayer optical film that reveals different colors in reflected and transmitted light.

47. The article of claim 46, wherein the foam layer is embossed to reveal the multilayer optical film.

48. The article of claim 47, wherein the embossing process compresses the multilayer optical film such that a different color is observed in transmission.

49. The article of claim 46, wherein the embossing process compresses the multilayer optical film such that a different color is observed in reflection.

50. An ink receptive article comprising a substrate having thereon an antistatic layer selected from the group consisting of vanadium pentoxide, antimony oxide, and a PEDT/PSS (poly(3,4-ethylenedioxythiophene) poly(styrenesulfonate)) conductive polymer; and an ink receptive layer, wherein the ink receptive layer comprises:

a major component of a urethane polymer copolymers and blends thereof with acrylic polymers, a crosslinker, wherein the crosslinker is present at 1 wt % to 10 wt % of the amount of polymer in the ink receptive layer, and about 5% to about 20% by weight of an ink absorber selected from the group consisting of metal oxides and silicas, and wherein the ink receptive layer further comprises printed indicia comprising an organic solvent-based ink.

51. The article of claim 50, wherein the antistatic layer is adjacent to the substrate.

52. The article of claim 50, wherein the antistatic layer is adjacent to the ink receptive layer.

53. A security document comprising a substrate having on at least a portion of a major surface thereof an antistatic layer selected from the group consisting of vanadium pentoxide, antimony oxide, and a PEDT/PSS (poly(3,4-ethylenedioxythiophene) poly(styrenesulfonate)) conductive polymer, and wherein the antistatic layer has on at least a portion of a major surface thereof an ink receptive layer capable of receiving an organic solvent-based ink, wherein the ink receptive layer comprises a major component of a crosslinked urethane polymer and copolymers and blends thereof with acrylic polymers, and about 5% to about 20% by weight of an ink absorber selected from the group consisting of metal oxides and silicas.

* * * * *

UNITED STATES PATENT AND TRADEMARK OFFICE

CERTIFICATE OF CORRECTION

PATENT NO. : 8,012,550 B2
APPLICATION NO. : 11/538606
DATED : September 6, 2011
INVENTOR(S) : Caroline Melkonian Ylitalo It is certified that error appears in the above-identified patent and that said Letters Patent is hereby corrected as shown below:

Title Pg, Item (57)
(Abstract); Line 7, Delete "polyacrlylics," and insert -- polyacrylics, --, therefor.

Column 2
Line 10, Delete "a" and insert -- at --, therefor.
Line 18, Delete "thereof," and insert -- thereof; --, therefor.

Column 4
Line 35, Delete "Celnax" and insert -- Celmax --, therefor.

Column 6
Line 4-5, Delete "pyrophylite," and insert -- pyrophyllite, --, therefor.
Line 6, Delete "diatomatious" and insert -- diatomaceous --, therefor.
Line 48-49, After "pyrrolidone" insert -- . --.

Column 8
Line 20, Delete "A" and insert -- An --, therefor.

Column 9
Line 5, Delete "thereof," and insert -- thereof; --, therefor.
Line 7, Delete "Wilimington," and insert -- Wilmington, --, therefor.
Line 12, Delete "actetate" and insert -- acetate --, therefor.

Column 12
Line 18, Delete "coalescense" and insert -- coalescence --, therefor.
Line 28, Delete "coalescense" and insert -- coalescence --, therefor.
Line 65, Delete "benzenesulfonhydrazide," and insert -- benzenesulfonylhydrazide, --, therefor.

Signed and Sealed this
Fifteenth Day of May, 2012

David J. Kappos

David J. Kappos
*Director of the United States Patent and Trademark Office*

Column 21
Line 22, Delete "(Billierica, MA)" and insert -- (Billerica, MA) --, therefor.
Line 24, Delete "(Wannington," and insert -- (Warrington, --, therefor.

Column 29
Line 29, Claim 11, Delete "a" and insert -- at --, therefor.